US006279307B1

(12) United States Patent
Nakaji et al.

(10) Patent No.: US 6,279,307 B1
(45) **Date of Patent: *Aug. 28, 2001**

(54) TENSION CONTROL METHOD USING FLUFF CONTROL DEVICE

(75) Inventors: Fumiaki Nakaji, Kyoto; Tomonari Ikemoto, Uji, both of (JP)

(73) Assignee: Murata Kikai Kabushiki Kaisha, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/296,126

(22) Filed: Apr. 22, 1999

(30) Foreign Application Priority Data

Jun. 12, 1998 (JP) ..... 10-164667

(51) Int. Cl.[7] ..... D02G 1/02

(52) U.S. Cl. ..... 57/334; 57/264; 57/265; 57/282; 57/284

(58) Field of Search ..... 57/334, 264, 265, 57/282, 284, 332, 337, 338, 339

(56) References Cited

U.S. PATENT DOCUMENTS 5,146,739 * 9/1992 Lorenz ..... 57/264
5,966,918 * 10/1999 Kino et al. ..... 57/264

FOREIGN PATENT DOCUMENTS

0866014A2 * 3/1999 (EP) ..... 57/264

* cited by examiner

*Primary Examiner*—John J. Calvert
*Assistant Examiner*—Shaun R Hurley
(74) *Attorney, Agent, or Firm*—Armstrong, Westerman, Hattori, McLeland & Naughton, LLP

(57) ABSTRACT

The present invention introduces a yarn y that is unwound from a supply bobbin 1 into a control member 3 for controlling the propagation of twisting toward a supply bobbin, then introduces the yarn into a friction-disk-type false twister 4 to suppress fluff, and finally controls the yarn feeding speed in the friction-disk-type false twister in order to control the yarn tension. The present invention can reduce the amount of fluff on a yarn that is unwound from a supply bobbin and wound around a winding package and control the yarn tension. Therefore, the present invention eliminates the needs for a special device for controlling the tension.

2 Claims, 6 Drawing Sheets

TENSION CONTROL METHOD USING FLUFF CONTROL DEVICE

FIELD OF THE INVENTION

The present invention relates to a yarn tension control method using a fluff control device that reduces the amount of fluff (hairiness) protruding from the surface of a spun yarn during winding.

BACKGROUND OF THE INVENTION

A fluff control device such as that shown in FIG. 4 has been proposed in Japanese Patent Application No. 8-322222, which precedes the present application.

In the fluff control device according to the above application, yarn y is unwound from a stationary cop 1 produced by a spinning machine, upwardly in the axial direction of the cop 1, and is inserted, via a balloon control cylinder 2, into a guide hole 3*a*' of a support plate 3*a* of a control member 3, which comprises support plates 3*a* arranged in the vertical direction at a predetermined interval and having guide holes 3*a*', and a capsule tenser 3*b* sandwiched by the support plates 3*a*, and the yarn y then comes into contact with the circumferential surface of the capsule tenser 3*b* and is then supplied to a friction-disk-type false twister 4. Thereafter, the yarn y is wound via a yarn splicer 5 and a yarn clearer 6 around a cone-shaped winding package 8 rotated by means of a driving drum 7 while being traversed by means of a traverse device (not shown in the drawing).

The friction-disk-type false twister 4 provided on a yarn path between the cop 1 and the winding package 8 applies false twists to the yarn y, and in a twisting area that is located below the friction-disk-type false twister 4, the yarn y is twisted in a predetermined direction. The control member 3 arranged below the friction-disk-type false twister 4 controls the downward propagation of the twist below the control member 3, thereby effectively twisting the yarn y. Thus, by applying the false twists to the yarn y, the fluff protruding from the surface of the yarn y can be twisted in and be suppressed.

First of all, a description will be given with respect to the variations in tension in a conventional winding process in which the yarn y is unwound upwardly in the axial direction of the cop 1 and then wound around the cone-shaped winding package 8 rotated by the driving drum 7 while being traversed by means of a traverse device (not shown in the drawing).

As shown in FIG. 5, an empty cone-shaped bobbin 9 is supported by cradle arms 10, and a rubber ring 11 with a diameter larger than the long-axis diameter of the empty cone-shaped bobbin 9 is mounted to the bobbin holder 10*a* arranged at the cradle arm 10 on the long-axis diameter side of the empty cone-shaped bobbin 9. When the yarn y is first wound around the empty cone-shaped bobbin 9, the empty cone-shaped bobbin 9 does not contact the driving drum 7, but its rubber ring 11, which has a larger diameter than the long-axis diameter of the empty cone-shaped bobbin 9 does contact the driving drum 7. Thus, the empty cone-shaped bobbin 9 is rotated to allow the yarn y traversed by the traverse device (not shown in the drawing) to be wound around the empty cone-shaped bobbin 9.

As described above, the rubber ring 11 with a diameter larger than the long-axis diameter of the empty cone-shaped bobbin 9 contacts the driving drum 7 to rotate the empty cone-shaped bobbin 9 and the yarn y is wound around the empty cone-shaped bobbin 9. Once, however, the yarn layer formed around the empty cone-shaped bobbin 9 exceeds the outer circumferential surface of the rubber ring 11, the surface of the yarn layer wound around the empty cone-shaped bobbin 9 comes into contact with the driving drum 7 to rotate the winding package 8. Thus, the driving of the cone-shaped winding package 8 with the yarn layer formed therein is transferred from a drive based on the contact of the rubber ring 11 with the driving drum 7 to a drive based on the contact of the surface of the yarn layer of the winding package 8 with the driving drum 7. Thus, the yarn y unwound from the cop 1 is wound around the empty cone-shaped bobbin 9 to form the cone-shaped winding package 8.

The friction-disk-type false twister 4 will be described below mainly with reference to FIG. 4.

The friction-disk-type false twister 4 is structured so that a plurality of friction disks 4*b* are mounted onto three respective vertical shafts 4*a* disposed so as to appear to be positioned at the apex of a regular triangle when viewed from above. The friction disks 4*b* mounted onto the respective vertical shafts 4*a* are arranged so as to appear to be staggered when viewed from the side and so that part of each disk appears to overlap another disk when viewed from above (In FIG. 4, the vertical shaft located between and behind the two illustrated vertical axes 4*a*, as well as the friction disk mounted onto this vertical shaft, is omitted). The three vertical axes 4*a* are rotated in the same direction to twist the yarn y inserted between the friction disks 4*b* and bent in a zigzag manner.

As described above, the false twists are applied to the yarn y by means of a friction-disk-type false twister 4 provided on the yarn path between the supply bobbin 1 and the winding package 8. In the twisting area located below the friction-disk-type false twister 4, the yarn y is twisted in a predetermined direction. However, by means of the control member 3 arranged below the friction-disk-type false twister 4, the downward propagation of the twist below the control member 3 is controlled, thereby effectively twisting the yarn y. Thus, by applying the false twists to the yarn y, the fluff protruding from the surface of a yarn y can be twisted in and be suppressed.

The variations in tension occurring when the yarn from a single full package cop 1 is wound around the empty cone-shaped bobbin 9 will be described below mainly with reference to FIG. 6. The tension of the yarn y is measured by means of an appropriate tension measuring device T located near and between the yarn splicer 5 and the yarn clearer 6.

At the beginning of the winding of the yarn y around the empty cone-shaped bobbin 9, the friction disks 4*b* of the friction-disk-type false twister 4 are rotated to twist the yarn y that is stopped and set at a zero tension, while the empty cone-shaped bobbin 9 begins to rotate to wind the yarn y around the empty cone-shaped bobbin 9. Thus, the tension of the yarn y increases rapidly in a linear manner from a point (a) of zero tension to a point of tension (b), as shown in FIG. 6A. This process of increased tension continues until the yarn y reaches a constant running speed. During this interval, the friction disks 4*b* of the friction-disk-type false twister 4 gradually increase their rotation speed from a state of inactivity, and once they enter a steady state, the disks 4*b* continue to rotate at a substantially constant speed.

After the yarn y has reached this normal running speed, namely, after the point of the tension (b), the tension gradually increases to reach a point (c). This gradual increase in tension occurs because the yarn y is unwound from the cop 1 to reduce the diameter of the cop 1 while increasing the unwinding resistance of the yarn y from the cop 1.

Then, when the drive of the cone-shaped winding package 8 with the yarn layer formed therein is transferred from the drive based on the contact of the rubber ring 11 with the driving drum 7 to the drive based on the contact of the surface of the yarn layer of the winding package 8 with the driving drum 7 as described above, the tension of the yarn y increases rapidly in a linear manner from a point of tension (c) to a point of tension (d). This rise occurs because when the drive based on the contact of the rubber ring 11 with the driving drum 7 is transferred to the drive based on the contact of the surface of the yarn layer of the winding package 8 with the driving drum 7, the shorter diameter side of the winding package 8 rotating at a high circumferential speed first comes into contact with the driving drum 7, thereby rapidly increasing the running speed of the yarn y.

After the drive of the cone-shaped winding package 8 with the yarn layer formed therein has been transferred from the drive based on the contact of the rubber ring 11 with the driving drum 7 to the drive based on the contact of the surface of the yarn layer of the winding package 8 with the driving drum 7, the only variation in the tension of the yarn y is a minor increase in tension occurring because the yarn y is unwound from the cop 1 to reduce the diameter of the cop 1 while increasing the unwinding resistance of the yarn y from the cop 1 as described above. Thus, the tension gradually increases from the point of tension (d) to a point of tension (e).

When the amount of yarn y remaining in the cop 1 becomes very small, and in particular, when the final part of the yarn y wound around the bottom of the cop 1 is drawn out, the tension increases rapidly in a linear manner from the point of tension (e) to a point of tension (f). When all the yarn y in the cop 1 is used up, the tension obviously becomes zero, as shown by a point (g).

As described above, the tension significantly varies when the yarn y in the single full package cop 1 is wound around the empty cone-shaped bobbin 9 and the cone-shaped winding package 8 with the yarn layer formed therein, as shown in FIG. 6A. Then, the rotation speed of the friction disks 4*b* of the friction-disk-type false twister 4 increases in a linear manner from the inactive state to the steady state (A'), as shown in FIG. 6B, and after the rotation speed has reached the steady state (A'), it remains constant until the rotation is stopped after the exhaustion of the yarn y in the cop 1.

It is an object of the present invention to provide a tension control method using a fluff control device capable of reducing large variations in tension in the above conventional fluff control device to maintain a more constant tension.

SUMMARY OF THE INVENITON

To achieve the above object, a first aspect of the present invention introduces yarn that is unwound from a supply bobbin into a control member for controlling the propagation of twisting toward a supply bobbin, and then introduces the yarn into a friction-disk-type false twister to suppress fluff, and controls the yarn feeding speed in the friction-disk-type false twister in order to control the yarn tension. According to a second aspect of the present invention, the yarn feeding speed in the friction-disk-type false twister is sequence-controlled based on the variations in yarn tension occurring if the yarn feeding speed in the friction-disk-type false twister is constant. According to a third aspect of the present invention, the friction-disk-type false twister controls the yarn feeding speed using feedback control.

DETAILED DESCRIPTION OF THE DRAWING

Figure 1:
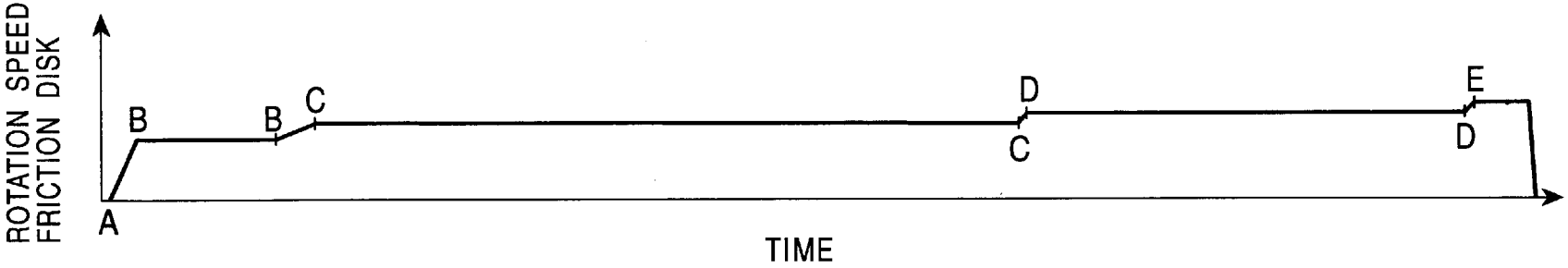
FIG. 1 is a friction disk rotation speed control pattern used in a tension control method using a fluff control device according to the present invention.

An embodiment of the present invention will be described below. However, the present invention is not limited to this embodiment as long as the spirit of the present invention adhered to. Constituent members that are the same as those in the above conventional winding device have the same reference numerals, and a detailed description of the constituent members will be omitted.

As described above, the friction-disk-type false twister 4 provided on the yarn path between the supply bobbin 1 and the winding package 8 applies the false twists to the yarn y, and in the twisting area located below the friction-disk-type false twister 4, the yarn y is twisted in a predetermined direction. Thus, by applying the false twists to the yarn y, fluff protruding from the surface of the yarn y is twisted in and be suppressed.

In addition, the friction disk 4*b* of the friction-disk-type false twister 4 has the function of contacting and twisting the yarn y, while simultaneously feeding the yarn y. Thus, the rotation speed of the friction disk 4*b* can be increased and reduced to adjust the amount of yarn y fed, thereby controlling the tension of the yarn y wound around the winding package 8. In other words, if the rotation speed of the friction disk 4*b* is reduced and thus the feeding speed of the yarn y is reduced, then, because the winding speed of the winding package 8 that contacts the driving drum 7, which rotates at a constant speed, is constant, the yarn y is tensioned between the winding package 8 and the friction-disk-type false twister 4 to increase the tension, which is measured by the tension measuring device T. Conversely, if the rotation speed of the friction disk 4*b* is increased and thus the feeding speed of the yarn y is increased, then, because the winding speed of the winding package 8 that contacts the driving drum 7, which rotates at a constant speed, is constant, the yarn y becomes slack between the winding package 8 and the friction-disk-type false twister 4 and its tension, which is measured by the tension measuring device T, is lowered.

A means for reducing large variations in tension in the above fluff control device using the tension control function of the above friction-disk-type false twister 4 will be described below mainly with reference to FIG. 1.

Figure 6A:
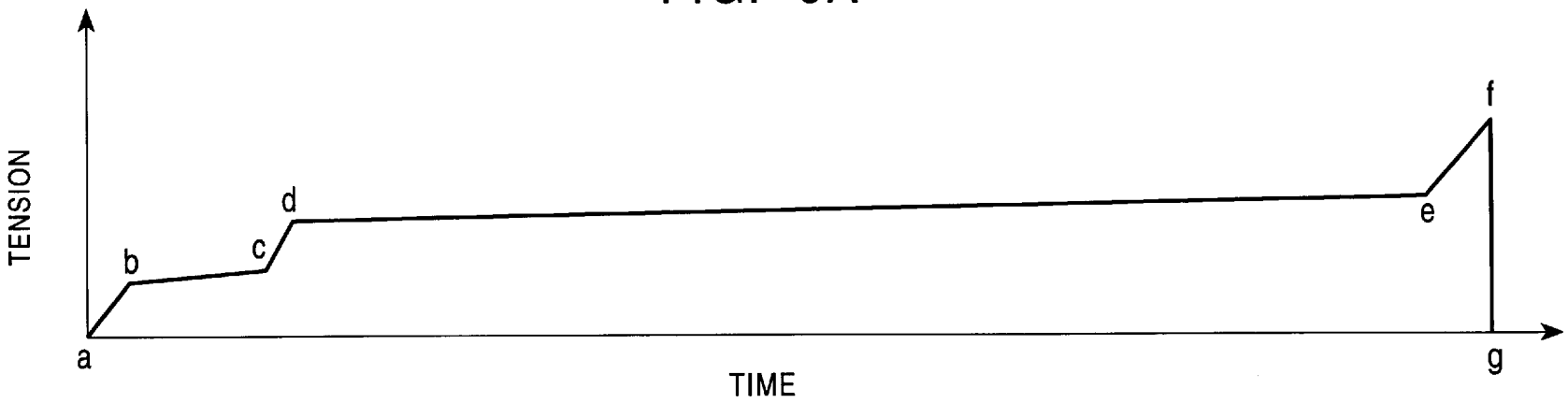
FIG. 6 shows a tension variation pattern and a friction disk rotation speed pattern in a winding device in which a conventional fluff control device is disposed.

When the yarn y in a single package full cop 1 produced by a spinning machine is wound around the winding package 8, almost the same tension variation pattern as that shown in FIG. 6A is observed if the cop 1 has been manufactured under the same spinning conditions. Thus, in such case, a drive device such as a motor for rotationally driving the friction disks 4*b* of the friction-disk-type false twister 4 can be sequence-controlled to obtain a tension variation pattern exhibiting fewer variations in tension.

At the beginning of the winding of the yarn y around the empty cone-shaped bobbin 9, the friction-disk-type false twister 4 is driven and controlled so that the friction disks 4*b* of the friction-disk-type false twister 4 increase their rotation speed linearly from the inactive state at point (A), and the friction-dist-type false twister 4 is also driven and controlled so that the winding package 8 reaches a rotation speed (B) lower than that of the friction disk 4*b*, which rotates due to the contact between the surface of the yarn layer on the winding package 8 and that of the driving drum 7. As described above, when the yarn y is first wound around the empty cone-shaped bobbin 9, the empty cone-shaped bobbin 9 does not contact the driving drum 7, but the rubber ring 11 does contact the driving drum 7 to rotate the empty cone-shaped bobbin 9 or the winding package 8. Accordingly, the tension of the yarn y is low, so the yarn y is not fully wound around the empty cone-shaped bobbin 9 or the winding package 8 and is slipped relative to the surface of the empty cone-shaped bobbin 9 or the winding package 8. Thus, while the rubber ring 11 is contacting the driving drum 7 to rotate the empty cone-shaped bobbin 9 or the winding package 8, the friction disks 4*b* are rotated at rotation speed (B), which is lower than that of the friction disks 4*b* being rotated due to the contact between the surface of the yarn layer of the winding package 8 and that of the driving drum 7. This operation ensures that the yarn y by the friction disk 4*b* is fed at a low speed and that the tension of the yarn y remains high between the winding package 8 and the friction-disk-type false twister 4. This configuration prevents the yarn slip.

Once a yarn layer exceeding the outer circumferential surface of the rubber ring 11 has been formed around the empty cone-shaped bobbin 9, the surface of the yarn layer of the winding package 8 comes into contact with the driving drum 7. As described above, however, when the drive of the cone-shaped winding package 8 with the yarn layer formed therein is transferred from the drive based on the contact of the rubber ring 11 with the driving drum 7 to the drive based on the contact of the surface of the yarn layer of the winding package 8 with the driving drum 7, the tension of the yarn y increases rapidly in a linear manner between points of tension (c) and (d), as shown in FIG. 6A. In order to prevent this rapid increase in tension and instead maintain a constant tension, the rotation speed of the friction disk 4*b* is increased linearly from rotation speed (B) to rotation speed (C) in accordance with the above linear increase in tension. This operation increases the feeding speed of the yarn y using the friction disks 4*b* to reduce the tension of the yarn y between the winding package 8 and the friction-disk-type false twister 4, and prevents any increase in tension, thereby ensuring that the tension remains constant.

After the drive based on the contact of the rubber ring 11 with the driving drum 7 is transferred to the drive based on the contact of the surface of the yarn layer of the winding package 8 with the driving drum 7, the rotation speed of the friction disks 4*b* is maintained at the rotation speed (C) for some time.

After the drive of the cone-shaped winding package 8 with the yarn layer formed therein is transferred from the drive based on the contact of the rubber ring 11 with the driving drum 7 to the drive based on the contact of the surface of the yarn layer of the winding package 8 with the driving drum 7, the final part of the yarn y wound around the bottom of the cop 1 is drawn out. Consequently, before the rapid increase in tension occurs as shown in FIG. 6A between points of tension (e) and (f), the rotation speed of the friction disks 4*b* is increased from the rotation speed (C) to the rotation speed (D) at least once.

Thereafter, because the final part of the yarn y wound around the bottom of the cop 1 is drawn out, the rotation speed of the friction disks 4*b* is maintained at the rotation speed (D) until the rapid increase in tension occurs as shown in FIG. 6A between points of tension (e) and (f).

The rotation speed of the friction disks 4*b* is increased in a linear manner from the rotation speed (D) to the rotation speed (E) correspondingly to the rapid increase from point of tension (e) to point of tension (f) that occurs when the amount of yarn y remaining in the cop 1 becomes very small, and in particular, when the final part of the yarn y wound around the bottom of the cop 1 is drawn out, and in addition, this rotation speed (E) is maintained until all the yarn y in the cop 1 has been used up. Thus, the rotation speed of the friction disk 4*b* is increased linearly from the rotation speed (D) to the rotation speed (E) in accordance with the above linear increase in tension so to increase the feeding speed of the yarn y, which is determined by the friction disks 4*b*. This operation reduces the tension of the yarn y between the winding package 8 and the friction-disk-type false twister 4, and prevents any increase in tension, thereby ensuring that the tension remains constant.

Thereafter, once all the yarn y in the cop 1 has been exhausted, the friction disks 4*b* are stopped.

As described above, after the drive of the cone-shaped winding package 8 with the yarn layer formed therein is transferred from the drive based on the contact of the rubber ring 11 with the driving drum 7 to the drive based on the contact of the surface of the yarn layer of the winding package 8 with the driving drum 7, the final part of the yarn y wound around the bottom of the cop 1 is drawn out. Consequently, before the rapid increase in tension occurs as shown in FIG. 6A between points of tension (e) and (f), the rotation speed of the friction disks 4*b* is increased from the rotation speed (C) to the rotation speed (D) at least once. If this operation is not performed, there will be a large difference between the rotation speed (C) and the rotation speed (E) obtained when the final part of the yarn y wound around the cop 1 is drawn out, resulting in the need to increase the rotation speed from the rotation speed (C) to the rotation speed (E) in a short time, thereby inhibiting smooth tension control.

A rotation speed control pattern for the friction disk 4*b* such as that shown in FIG. 1 can be created through experiments using the cop 1 used. Such a rotation speed control pattern is stored in a central control unit so that the driving means for the friction-disk-type false twister 4, such as a motor, is controlled based on the stored rotation speed control pattern.

Figure 2:
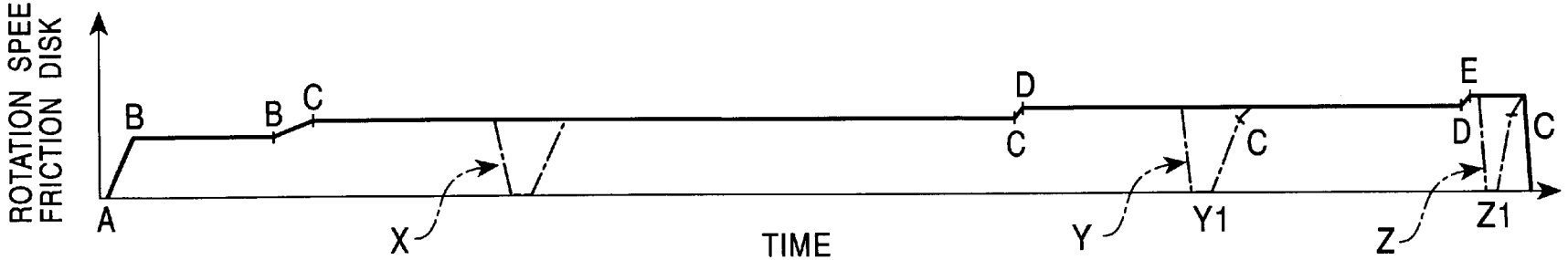
FIG. 2 is a rotation speed control pattern according to another embodiment of a friction disk in a tension control method using a fluff control device according to the present invention.

The solid-line portion of the rotation speed control pattern for the friction disks 4*b* shown in FIG. 2 is identical to that shown in FIG. 1. The rotation speed control pattern indicated by the dashed line is the rotation speed control pattern of the friction disks 4*b* used when the friction disks 4*b* are re-rotated after a yarn splicing operation has been performed to deal with yarn breakage that has stopped the rotation of the friction disks 4*b*.

The rotation speed control pattern X shown in FIG. 2 shows an example in which the yarn breaks at the rotation speed (C). When a yarn break occurs, the rotation of the friction disks 4*b* is stopped rapidly in a linear manner. After yarn spricing has been completed, the rotation speed of the friction disks 4*b* is increased linearly from zero in the inactive state to the rotation speed (C) using the same gradient as between zero in the inactive state (A) and the rotation speed (B) observed when the yarn y is first wound around the above the empty cone-shaped bobbin 9. The same gradient from the inactive state to the desired rotation speed enables a winding package with fewer variations in tension to be manufactured.

The rotation speed control pattern Y shown in FIG. 2 shows an example in which the yarn breaks at a rotation speed (D), which is higher than the rotation speed (C). In this case, the rotation of the friction disks 4*b* is also rapidly stopped using the same gradient as the stopping gradient of the above rotation speed control pattern X. After yarn splicing has been completed, the rotation speed of the friction disks 4*b* is increased linearly from the stop point (Y1) to the rotation speed (C) using the same gradient as in the rotation speed control pattern X. Then, the rotation speed is increased to the rotation speed (D) using a gentler gradient than between the stop point (Y1) and the rotation speed (C). Since the rotation speed control pattern from the stop point (Y1) to the rotation speed (C) is the same as the rotation speed control pattern X as described above, a winding package with fewer variations in tension can be manufactured. In addition, since the subsequent upward gradient is gentle, rapid variations in tension and associated yarn breakage can be prevented.

The rotation speed control pattern Z shown in FIG. 2 shows an example in which the yarn breaks at the rotation speed (E), which is higher than rotation speed (D). In this case, the rotation of the friction disks 4*b* is also rapidly stopped using the same gradient as the stopping gradient of the above rotation speed control patterns X and Y. After the yarn spricing has been completed, the rotation speed of the friction disks 4*b* is increased linearly from the stop point (Z1) to the rotation speed (C) using the same gradient as in the rotation speed control patterns X and Y. Then, the rotation speed is increased to the rotation speed (E) using a gentler gradient than between the stop point (Z1) and the rotation speed (C). Since the rotation speed control pattern from the stop point (Z1) to the rotation speed (C) is the same as the rotation speed control patterns X and Y as described above, a winding package with fewer variations in tension can be manufactured. In addition, since the subsequent upward gradient is gentle, rapid variations in tension and associated yarn breakage can be prevented.

Figure 6B:
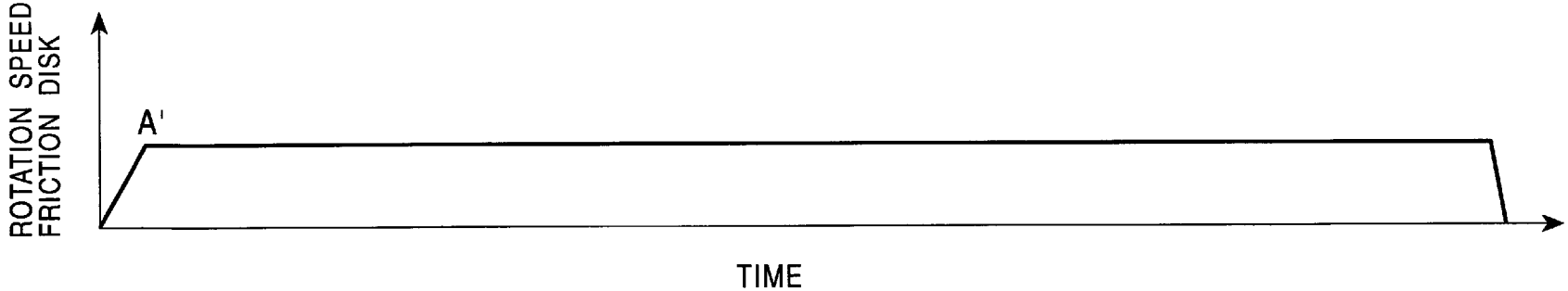

As described above, based on the variation in yarn tension that occurs if the yarn y feeding speed in the friction-disk-type false twister 4 shown in FIG. 6 is constant, this feeding speed in the friction-disk-type false twister 4 can be sequence-controlled, thus, it becomes possible to effectively control the tension using a simple means rather than a complicated control means.

Figure 3:
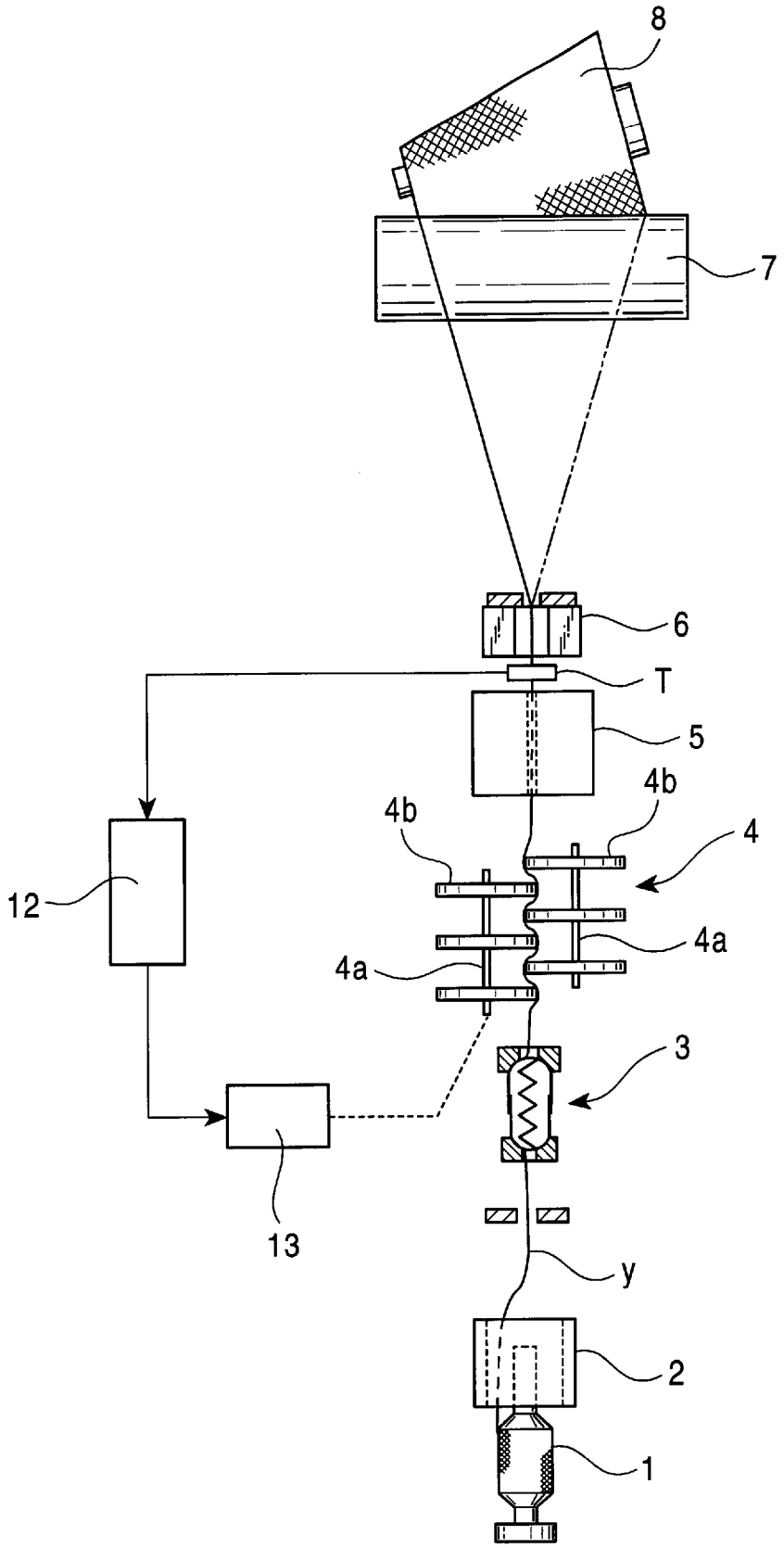
FIG. 3 is a schematic front view of a winding device to which the tension control method using the fluff control device according to the present invention is applied.
Figure 4:
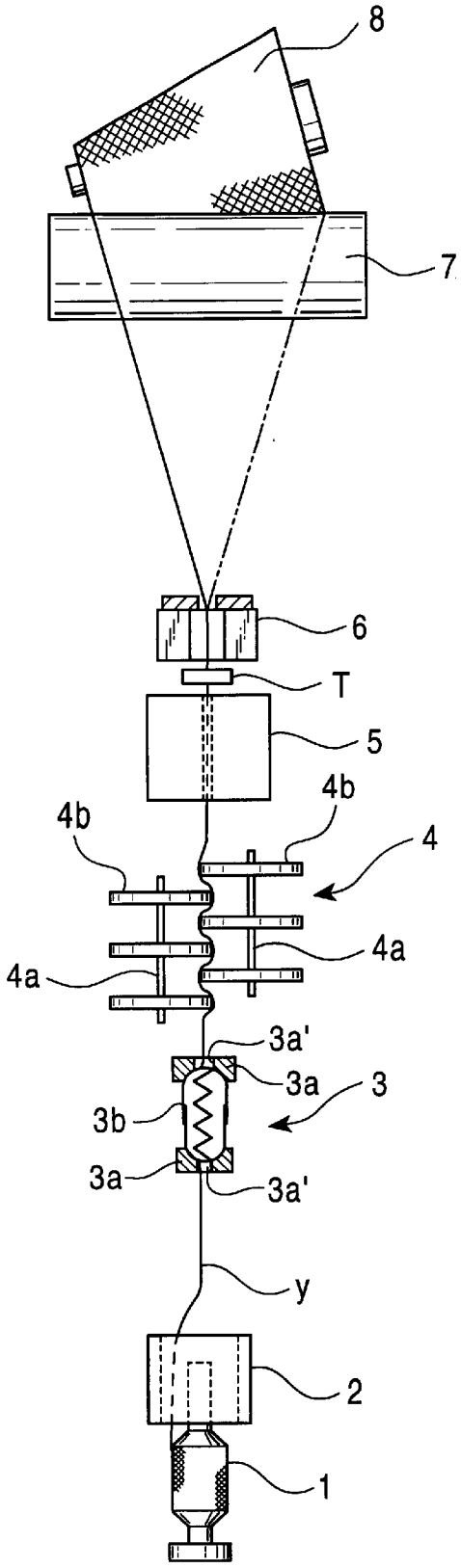
FIG. 4 is a schematic front view of the winding device.
Figure 5:
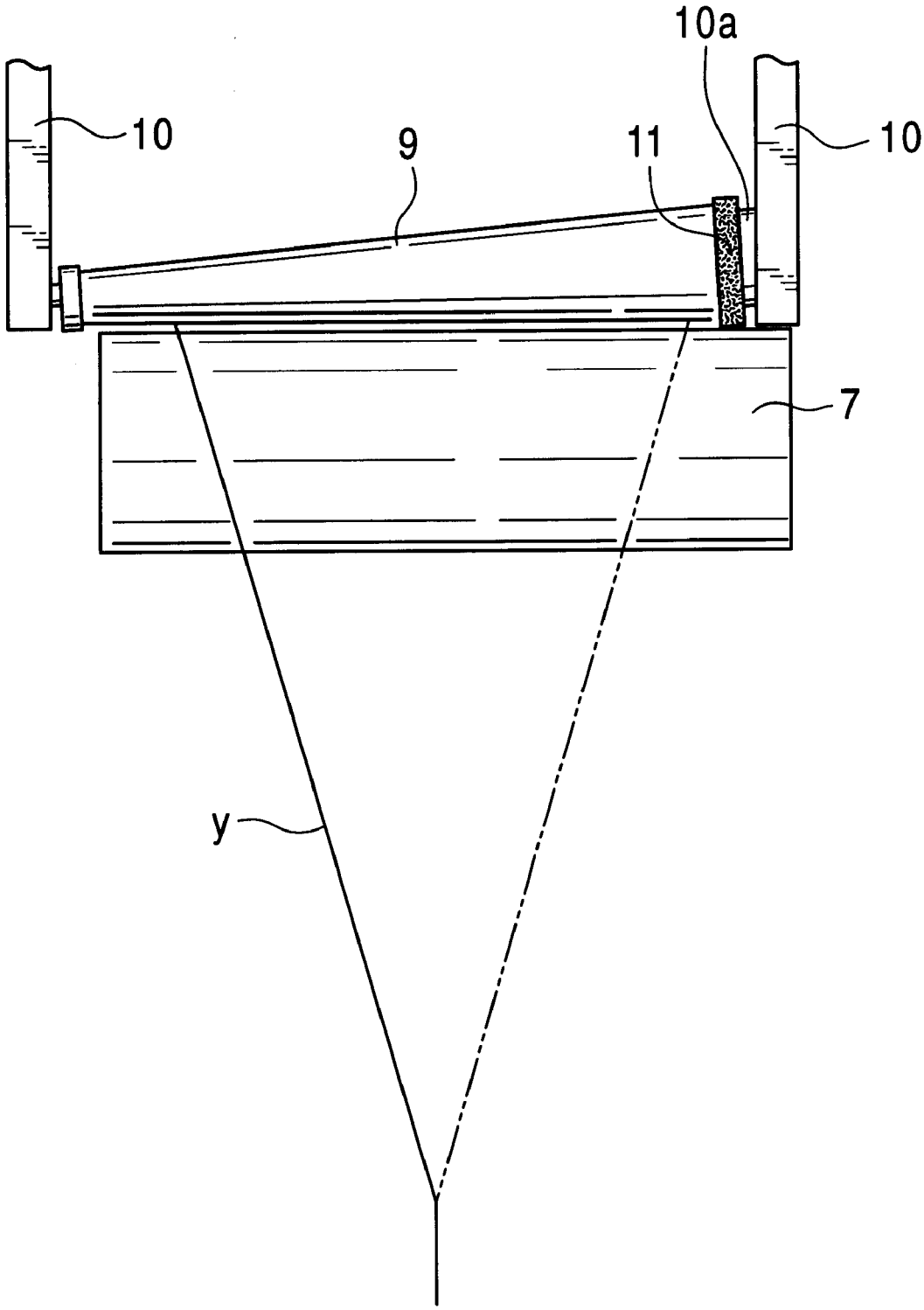
FIG. 5 is a partially expanded front view of the vicinity of a winding package.

Next, the use of a feedback method to increase and reduce the rotation speed of the friction disks 4*b* of the friction-disk-type false twister 4 in order to control tension will be described with reference to FIG. 3.

As described above, the tension of the yarn y measured by the appropriate tension measuring device T disposed near and between the yarn splicer 5 and the yarn clearer G is input into a central control unit 12, and is compared with a predetermined tension value stored in the central control unit 12. If the measured tension measured by the tension measuring device T is greater than the desired value stored in the central control unit 12, an instruction from the central control unit 12 controls a drive source 13, such as motor, of the friction-disk-type false twister 4 to increase the rotation speed of the friction disks 4*b*. Thus, the rotation speed of the friction disks 4*b* is increased to increase the yarn y feeding speed by the friction disks 4*b* in order to bring the tension of the yarn y between the winding package 8 and the friction-disk-type false twister 4 back down to a desired level, thereby maintaining a constant tension. Conversely, if the measured tension measured by the tension measuring device T is below the desired value stored in the central control unit 12, an instruction from the central control unit 12 controls the drive source 13 of the friction-disk-type false twister 4, such as a motor, to reduce the rotation speed of the friction disks 4*b*. Thus, the rotation speed of the friction disks 4*b* is reduced to reduce the yarn y feeding speed by the friction disks 4*b* in order to bring the tension of the yarn y between the winding package 8 and the friction-disk-type false twister 4 back up to a desired level, thereby maintaining a constant tension. Thus, use of this feedback-controlled enables more uniform tension control.

Although the above embodiment shows an example in which the supply bobbin from which the yarn y is unwound is a cop 1 that is produced by a spinning machine and in which the yarn y is unwound upward in the axial direction of the stationary cop 1, supply bobbins of various shapes can be used instead of the cop 1 produced by a spinning machine and a yarn feeding method for unwinding the yarn y while rotating the supply bobbin. In other words, the present invention can also be applied to devices where horizontal unwinding is employed. Moreover, instead of the cone-shaped bobbin 9, a cylindrical bobbin can be used in the winding method used to form a cylindrical winding package (parallel cheese).

Due to the configuration described above, the present invention has the following effects.

The present invention can reduce the amount of fluff (hairiness) on yarn that is unwound from a supply bobbin and wound around a winding package while controlling the yarn tension. Therefore, the present invention eliminates the need for a special apparatus for controlling the tension.

The yarn feeding speed in the friction-disk-type false twister is sequence-controlled to enable the tension to be effectively controlled using a simple means instead of a complicated control means.

The yarn feeding speed in the friction-disk-type false twister is feedback-controlled so as to enable more uniform tension control.

What is claimed is:

1. A tension control method that uses a fluff control device, comprising the steps of:

introducing a yarn that is unwound from a supply bobbin into a control member;

controlling the propagation of twisting toward the supply bobbin;

introducing the yarn into a friction-disk-type false twister;

suppressing any fluff; and controlling the yarn feeding speed in said friction-disk-type false twister so as to control the yarn tension, wherein the yarn feeding speed in the friction-disk-type false twister is sequence-controlled based on the variations in yarn tension occurring if the yarn feeding speed in the friction-disk-type false twister is constant.

2. A tension control method that uses a fluff control device comprising the steps of:

introducing a yarn that is unwound from a supply bobbin into a control member;

controlling the propagation of twisting toward the supply bobbin;

introducing the yarn into a friction-disk-type false twister;

suppressing any fluff; and controlling the yarn feeding speed in said friction-disk-type false twister so as to control the yarn tension, wherein the friction-disk-type false twister controls the yarn feeding speed using feedback such that the feedback controls the tension of the yarn between the winding package and the friction-disc-type false twister by means of the tension measuring device, the control unit and the drive source of the friction-disc-type false twister.

* * * * *